US009520657B2

(12) United States Patent
Lawson

(10) Patent No.: US 9,520,657 B2
(45) Date of Patent: Dec. 13, 2016

(54) ELECTRICAL TERMINAL

(71) Applicant: HUBBELL INCORPORATED, Shelton, CT (US)

(72) Inventor: Craig E. Lawson, Amherst, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/448,450

(22) Filed: Jul. 31, 2014

(65) Prior Publication Data

US 2016/0036141 A1 Feb. 4, 2016

(51) Int. Cl.

| | |
|---|---|
| ***H01R 11/11*** | (2006.01) |
| ***H01R 11/12*** | (2006.01) |
| ***H01R 4/20*** | (2006.01) |
| ***H01R 4/34*** | (2006.01) |

(52) U.S. Cl.

CPC ..... *H01R 11/12* (2013.01); *H01R 4/20* (2013.01); *H01R 4/34* (2013.01)

(58) Field of Classification Search

CPC ..... H01R 11/12
USPC ..... 439/883, 927, 444, 433, 966, 436
See application file for complete search history.

(56) References Cited

U.S. PATENT DOCUMENTS

| | | | | |
|---|---|---|---|---|
| 325,235 | A | 9/1885 | Bulmer et al. | |
| 329,615 | A | 11/1885 | Andrews | |
| 878,476 | A | 2/1908 | Barker | |
| 1,183,174 | A | 5/1916 | Dice | |
| 1,225,297 | A * | 5/1917 | Willard | H01R 11/281 439/760 |
| 1,724,595 | A | 8/1929 | Hyle | |
| 1,878,199 | A | 9/1932 | Stenger | |
| 1,916,526 | A | 7/1933 | Olson | |
| 2,034,258 | A | 3/1936 | Hausser | |
| 2,034,494 | A | 3/1936 | Stoll | |
| 2,069,402 | A | 2/1937 | Cowlin | |
| 2,149,359 | A | 3/1939 | Olson | |
| 2,179,575 | A * | 11/1939 | Hosking | F16B 39/24 411/162 |

(Continued)

FOREIGN PATENT DOCUMENTS

| | | |
|---|---|---|
| FR | 769005 | 8/1934 |
| FR | 49768 | 7/1939 |
| JP | 06309640 | 11/1994 |

*Primary Examiner* — Neil Abrams
(74) *Attorney, Agent, or Firm* — Dickinson Wright PLLC

(57) ABSTRACT

An electrical connector is provided as a one-piece, unitary element for providing electrical connection between an electrical cable and an electrical component. The electrical connector has a substantially planar body with a planar first surface and a planar second surface and a central aperture with a dimension to receive a fastener. At least one frusto-conical shaped projection extends from the body for contacting and penetrating into an electrical component. A cable terminal is integrally formed with the body and extends radially outward for coupling directly to an electrical cable and provides an electrical connection between the electrical cable and the body. The projection has an axial passage and forms an annular contact surface for mating with the electrical component. The projection can surround the central aperture of the body or can be a plurality of projections spaced outwardly from and uniformly spaced around the central aperture.

14 Claims, 5 Drawing Sheets

(56) References Cited

U.S. PATENT DOCUMENTS 2,250,280 A * 7/1941 Starbird ..... H01R 4/26 174/140 R
2,271,732 A 2/1942 Chappuis
2,561,679 A 7/1951 Waller
2,796,457 A 6/1957 Stinger
2,934,684 A 4/1960 Fegan
3,138,658 A 6/1964 Weimer
3,175,462 A 3/1965 Disley
3,247,316 A 4/1966 Weimer, Jr.
3,285,313 A 11/1966 Blakesley
3,340,494 A 9/1967 Gutshall
3,481,381 A * 12/1969 Black ..... F16B 39/24 411/162
3,504,101 A 3/1970 Muto
3,541,226 A 11/1970 Cea et al.
3,541,227 A 11/1970 Bendrick
3,626,357 A 12/1971 Kindell et al.
3,719,919 A 3/1973 Tibolla
3,761,867 A 9/1973 Churla
3,881,799 A * 5/1975 Elliott ..... H01R 4/26 174/253
4,022,262 A 5/1977 Gunn
4,023,882 A * 5/1977 Pettersson ..... H01R 4/26 439/426
4,060,301 A * 11/1977 Beatty ..... H01B 17/04 174/141 R
4,263,474 A 4/1981 Tennant
4,406,505 A 9/1983 Avramovich
4,473,714 A 9/1984 Brownell et al.
4,498,715 A 2/1985 Peppler
4,560,224 A 12/1985 Weisenburger
4,659,870 A 4/1987 Jones
4,704,058 A 11/1987 Crunwell
4,900,209 A 2/1990 Reynolds
4,961,712 A 10/1990 Schwenk et al.
5,078,613 A 1/1992 Salmon
5,100,506 A 3/1992 Sturtevant et al.
5,207,588 A 5/1993 Ladouceur et al.
5,236,272 A 8/1993 Hibbard
5,399,096 A 3/1995 Quillet et al.
5,435,746 A 7/1995 Leeb
5,441,417 A 8/1995 Ladouceur et al.
5,453,027 A 9/1995 Buell et al.
5,501,008 A 3/1996 Leeb
5,620,290 A * 4/1997 Homfeldt ..... F16B 39/108 411/162
5,644,830 A 7/1997 Ladouceur et al.
5,759,055 A * 6/1998 Colantuano ..... H01R 9/18 439/287
5,828,008 A 10/1998 Lockwood et al.
6,343,904 B1 2/2002 Wang
6,347,915 B1 2/2002 Balzano
6,368,038 B1 4/2002 Uno
6,535,394 B1 * 3/2003 Hirzmann ..... H05K 7/142 174/138 E
6,864,015 B2 * 3/2005 Peterson ..... H01M 2/305 429/182
6,939,097 B2 9/2005 Carr et al.
6,976,816 B2 12/2005 Slesinski et al.
6,987,660 B2 1/2006 Stevenson et al.
7,070,461 B1 * 7/2006 Pavlovic ..... H01R 11/12 439/766
8,070,404 B1 * 12/2011 Schluter ..... F16B 39/282 411/368
8,092,129 B2 * 1/2012 Wiley ..... F16B 7/187 411/160
8,303,357 B2 * 11/2012 Kuwahara ..... H01R 4/26 411/160
8,353,650 B2 1/2013 Wiley et al.
8,608,418 B2 12/2013 Wiley et al.
8,888,431 B2 * 11/2014 Haney ..... H01R 43/027 411/163
9,065,191 B2 * 6/2015 Martin ..... H01R 4/26
9,091,461 B2 * 7/2015 O'Brien ..... F24J 2/5237
2003/0031526 A1 2/2003 Grant
2014/0154924 A1 * 6/2014 Huang ..... H01R 13/58 439/627
2015/0083456 A1 * 3/2015 Chen ..... F16F 1/376 174/73.1
2016/0036141 A1 * 2/2016 Lawson ..... H01R 11/26 439/784

* cited by examiner

ELECTRICAL TERMINAL

FIELD OF THE INVENTION

The present invention is directed to an electrical terminal and connector for providing an electrical connection with a metal component. The invention is particularly directed to an electrical connector and to an electrical assembly for penetrating a coating or surface on a metal component during assembly for providing a direct, strong electrical connection between the electrical connector and the metal component.

BACKGROUND OF THE INVENTION

Various electrical connectors and devices are available for connecting metal parts together and attaching an electrical cable to a metal part or component and providing an electrical connection between the components.

Metal parts such as aluminum are often anodized to provide corrosion resistance. Aluminum and steel parts can also develop a layer of oxidation formed on the surface that can inhibit electrical connections. Various washers and other connectors are available that include teeth or barbs that are able to penetrate the metal surface to assist in forming an electrical connection between various parts. One example of a bonding washer is disclosed in U.S. Pat. Nos. 8,092,129, 8,353,650 and 8,608,418 to Wiley et al. which are hereby incorporated herein by reference in their entirety.

Other examples of washers include star washers that are punched and formed from a flat metal stock. The washers can have a plurality of internal or external teeth that can be twisted so that they extend above and below the plane of the washer body. The washers make an electrical connection to an adjacent piece by the teeth penetrating the surface of the metal as the washers are rotated and compressed by a nut and bolt being tightened.

While the prior devices have been suitable for their intended purpose, there is a continuing need in the industry for improved devices for forming an improved electrical connection between metal parts.

SUMMARY OF THE INVENTION

The present invention is directed to an electrical connector for providing an electrical connection between the electrical connector and a metal component. The invention is particularly directed to an electrical connector and to an electrical assembly where the electrical connector is able to penetrate a coating on a metal component, and particularly an electrical component, and providing a direct electrical connection between the electrical connector and the metal component.

The invention is directed to an electrical connector having an aperture for receiving a fastener for coupling the electrical connector to a metal part or component. The electrical connector has a contact surface for mating with the metal component that has at least one projection, barb or tooth for penetrating the surface of the metal component.

The electrical connector of the invention has at least one surface for contacting an electrical component and making an electrical connection with the electrical component. In one embodiment of the invention, the electrical connector has a surface for contacting the electrical component with a frustoconical shaped projection that is able to penetrate a surface coating or corrosion layer on the surface of the electrical component to ensure electrical contact between the electrical connector and the electrical component.

The invention is further directed to an electrical connector have an electrical wire or cable coupled to a terminal integrally formed with the connector and where the connector has one or more frustoconical shaped projections extending from at least one surface for penetrating a coating or oxidized surface of a metal component and where the frustoconical shaped projection surrounds a central aperture for receiving a fastener.

The various aspects of the invention are basically attained by providing a one-piece unitary electrical connector comprising a substantially planar body having a substantially planar first surface on a first side and a substantially planar second surface on a second side opposite the first surface, a central aperture extending between the first surface and the second surface and having a dimension to receive a fastener. The planar body has at least one projection extending from the first surface and an electrical terminal integrally formed with the body. The electrical terminal extends radially outward from a side edge of the body for coupling directly to an electrical cable or wire and to provide an electrical connection between the electrical cable or wire and the body.

The various features of the invention are also attained by providing a one-piece unitary electrical connector comprising a body having a substantially planar configuration with a substantially planar first surface and a substantially planar second surface opposite the first surface. A central aperture extends between the first surface and the second surface. At least one frustoconical shaped projection extends from the first surface and is oriented on a first side of the body surrounding the central aperture. An electrical terminal having a tab extends radially from a side edge of the body and has a cylindrical shaped cable connector extending radially outward from the body and oriented on a second side of the body opposite the first side. The electrical cable is received in the cylindrical cable connector where the cable connector is crimped onto the electrical cable to provide an electrical connection between the electrical cable and the body.

The features of the invention are also attained by providing an electrical assembly comprising a metal base having an aperture extending through an outer surface of the metal base, a metal clamping member overlying the outer surface of the metal base and having an aperture extending through the metal clamping member and aligned with the aperture in the base, and an electrical connector positioned between the metal base and the metal clamping member. The electrical connector has a body with a substantially planar first surface and a substantially planar second surface opposite the first surface. An aperture extends between the first surface and a second surface and is aligned with the aperture in the metal base and the metal clamping member. At least one frustoconical shaped projection extends from the first surface. The electrical terminal is integrally formed with the body and is coupled to an electrical cable. A fastener extends through the apertures in the metal base, the metal clamping member and the body for clamping the metal body between the metal base and the metal clamping member with the frustoconical shaped projection penetrating a surface of the metal base and providing an electrical connection between the wire and the metal base and the metal clamping member.

These and other objects and advantages of the invention will become apparent from the following detailed description of the invention which, taken in conjunction with the annexed drawings, disclose various embodiments of the invention.

BRIEF DESCRIPTION OF THE DRAWINGS

The following is a brief description of the drawings, in which.

DETAILED DESCRIPTION OF THE INVENTION

Figure 1:
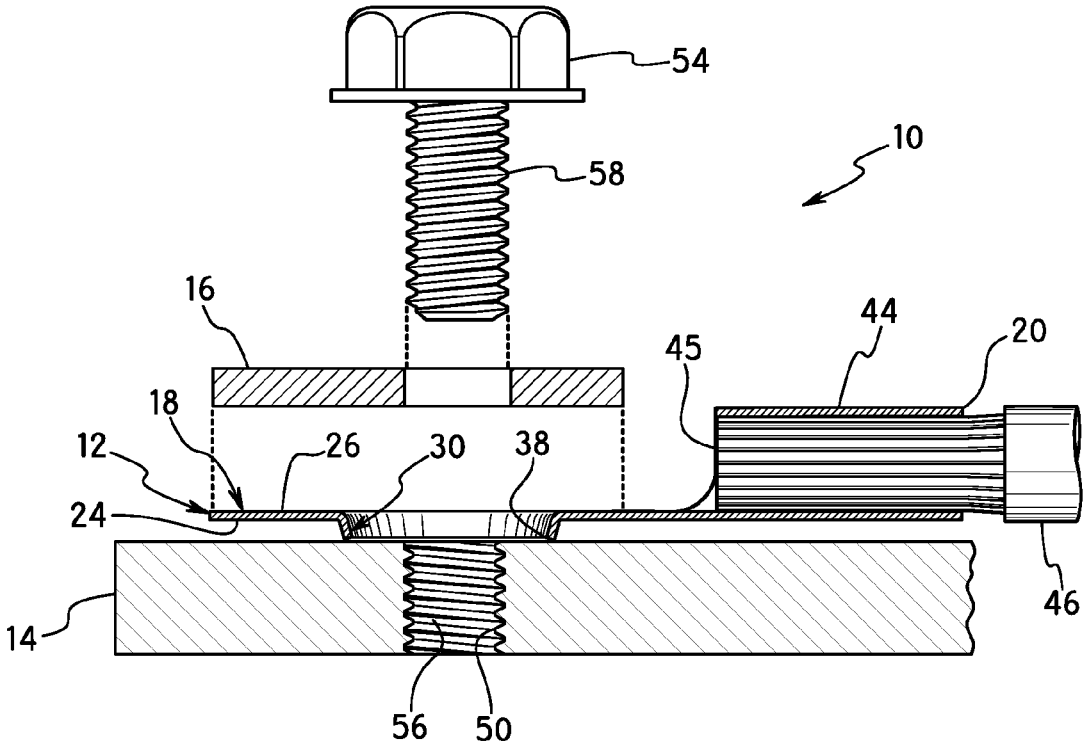
FIG. 1 is a cross-sectional exploded view in side elevation of the electrical assembly showing the metal base, clamping member and electrical connector.

The present invention is directed to an electrical connector for providing electrical contact with a metal component. The invention is particularly directed to an electrical connector and to an electrical assembly for penetrating a coating on a metal component and providing a direct and strong electrical connection between the electrical connector and the metal component.

Referring to the drawings, the electrical assembly 10 includes an electrical connector 12 for providing and ensuring an electrical connection between a metal base 14 and a metal clamping member 16.

The electrical connector 12 of the invention is particularly suitable for making an electrical connection between two metal pieces and between a metal piece or electrical component and the electrical cable wire. The invention is particularly suitable for use in the installing and constructing a photovoltaic array having a number of photovoltaic modules assembled together and providing electrical contact between the modules. The contact surfaces of the modules can have a corrosion resistant coating, such as an anodized layer or an oxidized layer, that can interfere with the electrical connection between the modules. The electrical connector of the present invention is able to penetrate the coating, anodized layer or oxidized layer to ensure a direct and strong electrical connection between the electrical connector 12 and the modules or other electrical component.

The metal base 14 can be a structural element, tab or flange of an electrical component where an electrical connection is desired between the metal base and the electrical cable or wire. The electrical cable or wire can provide an electrical connection to another electrical component. In further embodiments, the electrical cable or wire can be a ground wire for providing a ground connection between one or more electrical components.

The clamping member 16 can be a metal plate or washer for providing sufficient clamping force to the assembly 10. The clamping member 16 can also be a tab, flange or part of another structural element or electrical components.

The electrical connector 12 in the embodiments shown in the drawings is formed from a metal blank that is punched and formed to the final shape. The electrical connector 12 is formed as a one-piece, integrally formed member. The electrical connector 12 is typically made of steel, such as stainless steel, although other electrically conductive materials can be used.

The electrical connector 12 in the embodiment of FIGS. 1-6 includes a body 18 and an electrical terminal 20 integrally formed with the body 18. The body 18 has a substantially flat planar configuration with an outer edge 22, a first side surface 24 defining a first side and a second side surface 26 defining a second side of the body 18. The body 18 in the embodiment shown has a substantially flat planar configuration with a substantially circular outer edge 22. A central aperture 28 extends through the body 18 between the first side surface 24 and the second side surface 26. In the embodiment shown, the body 18 has a substantially annular shape formed by the central aperture 28. The central aperture 28 has a dimension for receiving a fastener for coupling the electrical connector 12 to an electrical component.

The electrical connector 12 is provided with at least one projection 30 forming a barb or tooth projecting from a plane of the body 18 for engaging the surface of a metal member or electrical component for providing electrical contact between the electrical connector and the metal member. In the embodiment of FIGS. 1-6, the projection 30 extends outwardly from the first surface 24 of the body 18.

The projection 30 in the embodiment of FIGS. 1-6 has a substantially frustoconical shape surrounding the central aperture 28 and extends outwardly from the plane of the body 18. The frustoconical shaped projection 30 is formed by a continuous side wall 32 having a base end 34 integrally formed with the body 18 and an outer second end 36 forming an annular edge 38. The side wall 32 converges or tapers inwardly toward the center axis of the central aperture 28 to form a substantially truncated, hollow volcano-like shape. The side wall 32 has an axial dimension sufficient to extend from the plane of the body 18 a distance to form an electrical contact with an electrical component. In one embodiment of the invention, the annular edge 38 is continuous and lies in a plane substantially parallel to a plane of the body 18 and spaced from the body 12 to provide continuous contact with the metal base 14.

The electrical terminal 20 is integrally formed with the body 18 and extends radially outward from the outer edge 22 of the body 18. The electrical terminal 20 includes a tab 40 and a terminal end 42 having a cable connector or crimp 44. The tab 40 is integrally formed with the body 18 and the cable connector 44. In the embodiment shown, the tab 40 extends from the outer edge 22 of the body 18 in a plane substantially parallel to the plane of the body 18. In one embodiment of the invention, the tab 40 is coplanar with the plane of the body 18 as shown.

Figure 2:
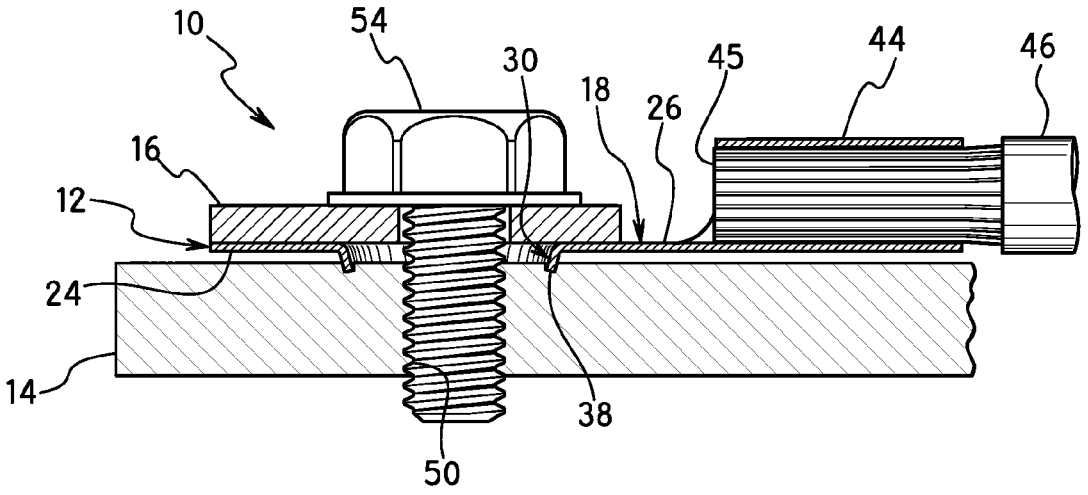
FIG. 2 is a cross-sectional view in side elevation showing the electrical assembly in the assembled condition.
Figure 3:
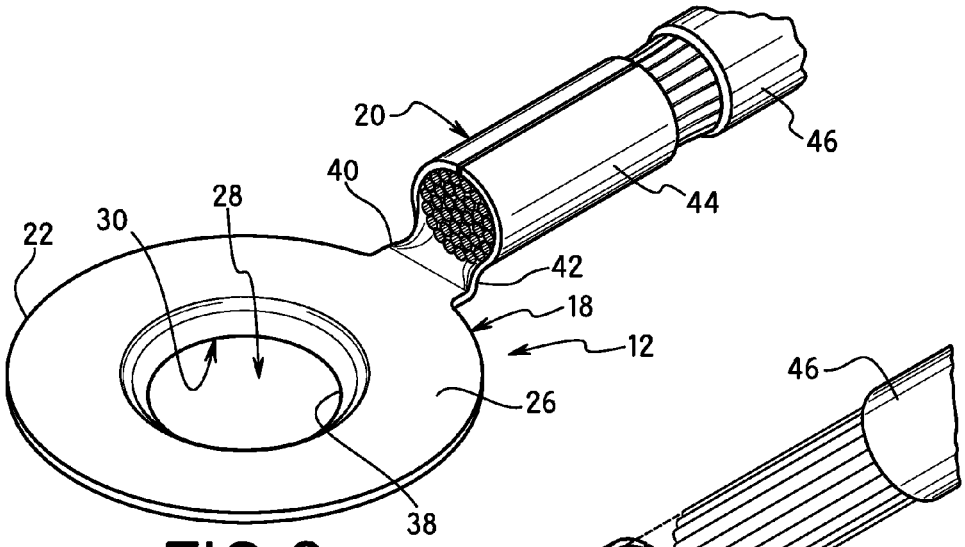
FIG. 3 is a perspective view showing the electrical connector in a first embodiment of the invention.
Figure 4:
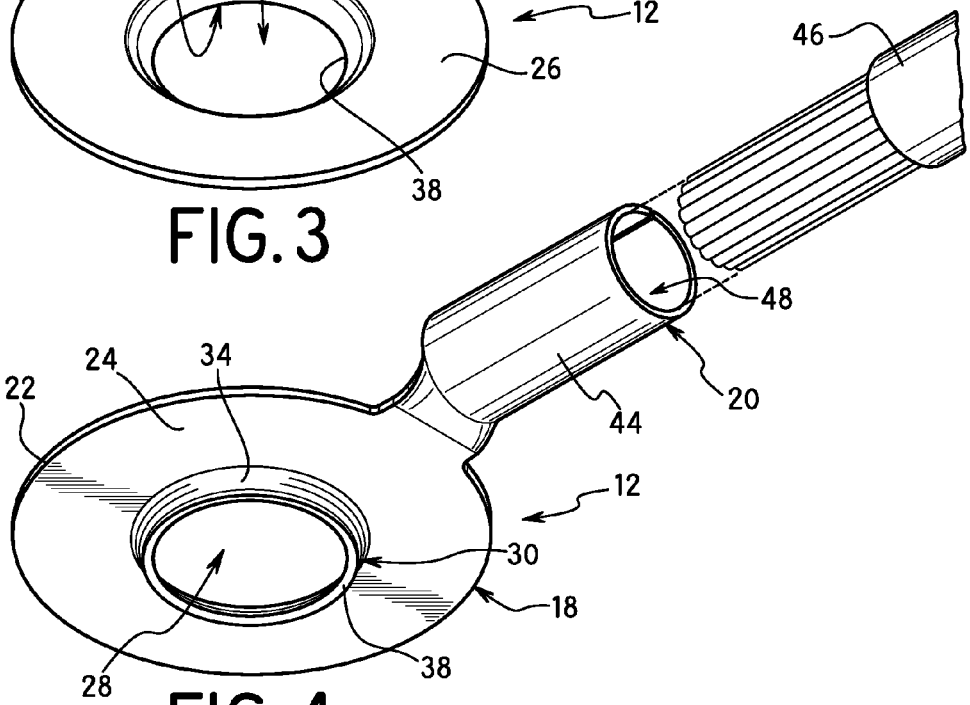
FIG. 4 is a bottom perspective view of the electrical connector of FIG. 3.
Figure 5:
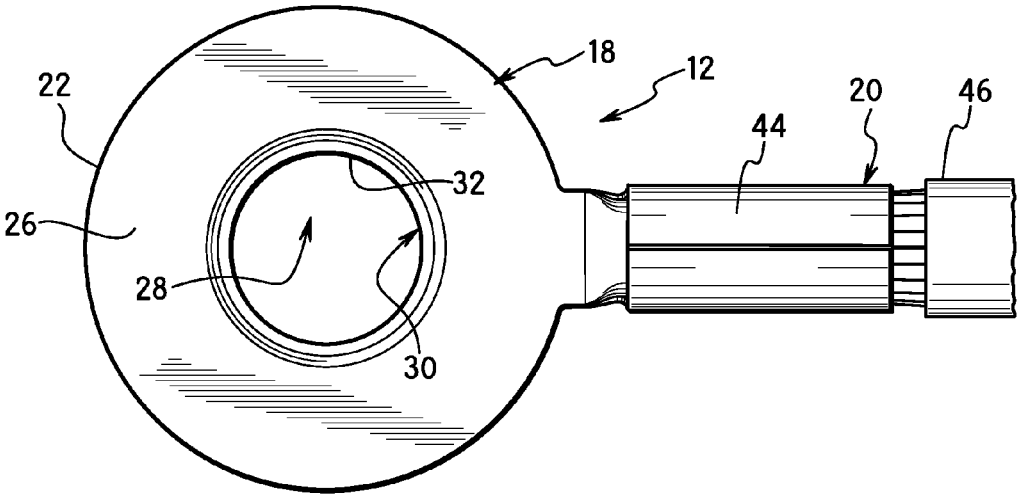
FIG. 5 is a top plan view of the electrical connector of FIG. 3.
Figure 6:
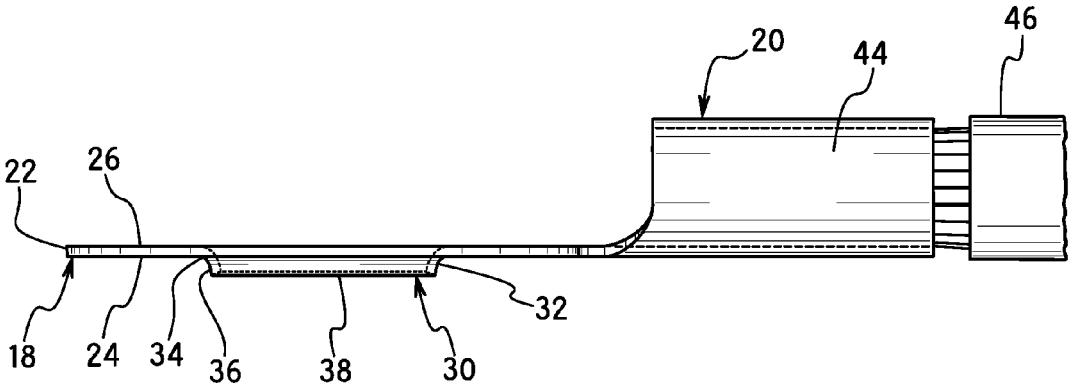
FIG. 6 is a side elevational view of the electrical connector of FIG. 3.

The cable connector 44 in one embodiment of the invention has a substantially cylindrical, barrel shape capable of coupling to an electrical cable 46 or wire as shown in FIGS. 1 and 2. The cable connector 44 is formed from two flanges extending in opposite directions with respect to the tab 40 and are folded so that the outer edges of the flanges are adjacent or next to each other and form the substantially cylindrical shape as shown in FIG. 3. Preferably, the cable connector 44 is oriented on a second side of the body 18 opposite the projection 30. The electrical strands 45 of cable 46 extend past the cable's insulation and are inserted into the axial passage 48 of the cable connector 44 and crimped to electrically and physically secure the electrical cable 46 to the cable connector 44 and the body 18.

In the embodiment shown, the metal base 14 is provided with an aperture 50 and the clamping member 16 is provided with an aperture 52 for receiving a fastener 54 for clamping the assembly together. The clamping member 16 in the embodiment shown can be a metal plate, electrical component, or washer capable of applying sufficient pressure or force to the electrical connector 12 to provide a strong, durable electrical connection between the various components. The metal base 14 is an electrical component where the electrical connection between the electrical connector 12 and the metal base 14 is needed.

In the embodiment shown, the aperture 50 in the base 14 is provided with internal threads 56 for mating with external threads 58 on the fastener 44. In alternative embodiments, the aperture 50 in the base 14 can have a smooth inner side wall surface and have a dimension to allow the fastener 54 to pass through. A bolt or nut can then be coupled to the external threads 58 of the fastener 54 for clamping the electrical assembly 10 together.

In the embodiment shown, the fastener 54 is passed through the aligned aperture 52 in the clamping member 16, the central aperture 28 of the electrical terminal 20, and the aperture 50 in the metal base 14. The fastener 54 is tightened to provide a sufficient force so that the annular edge 38 of the projection 30 forms an electrical connection with the metal base 14. The annular edge 38 of the projection 30 has a surface area that is able to penetrate a coating or layer of oxidation on the outer surface of the metal base 14 to ensure electrical connection between the metal base 14 and the electrical connector 12. The annular edge 38 of the frustoconical rejection 30 preferably forms a continuous annular contact area with the base 14 surrounding the aperture 50 in the base 14. The side wall of the projection 30 has a shape and dimension to resist crushing, bending or deformation by the clamping force to provide continuous electrical contact with the metal base 14. In one embodiment, the annular edge 38 is able to penetrate the surface of the base 14 to a depth to promote electrical contact as shown in FIG. 2.

Figure 13:
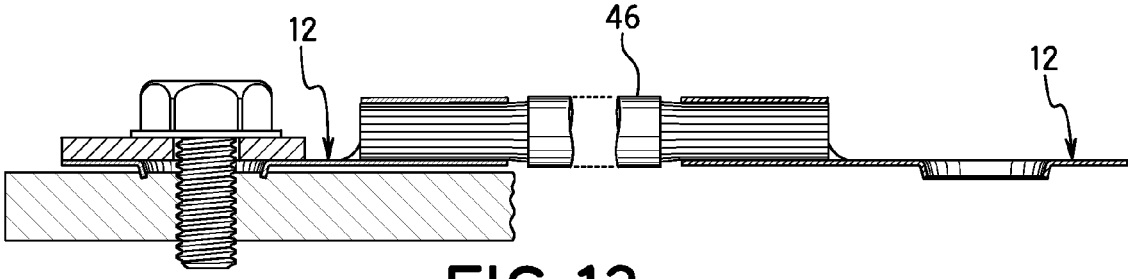
FIG. 13 is a cross-sectional side elevational view showing two electrical connectors coupled to a common electrical cable.

The electrical connector 12 is able to provide an electrical connection between the cable 46 and the metal base 14 by clamping the assembly 10 together. In one embodiment of the invention, an electrical connector 12 can be coupled directly to the opposite ends of the electrical cable 46 as shown in FIG. 13 to provide an electrical connection between two electrical components.

Figure 7:
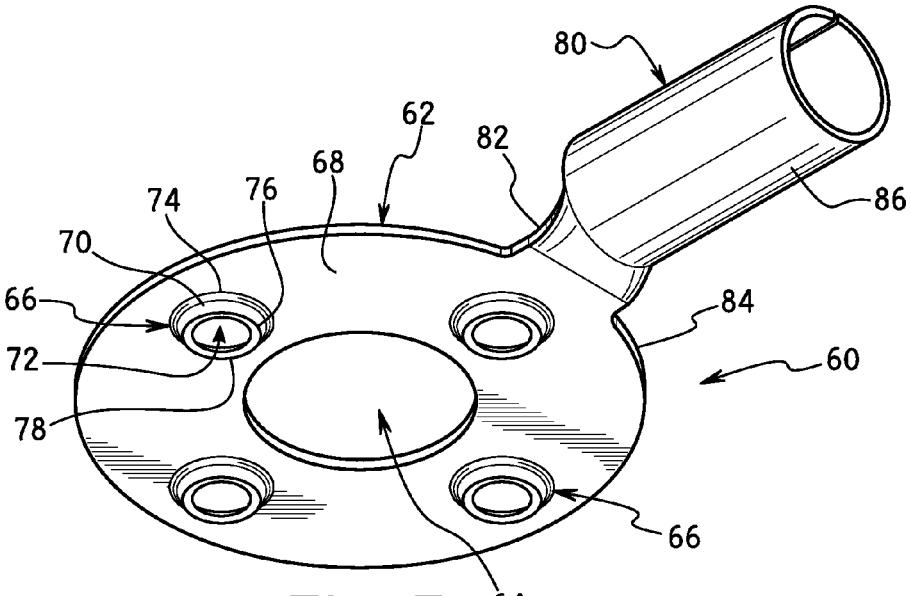
FIG. 7 is a bottom perspective view of the electrical connector in a second embodiment.
Figure 8:
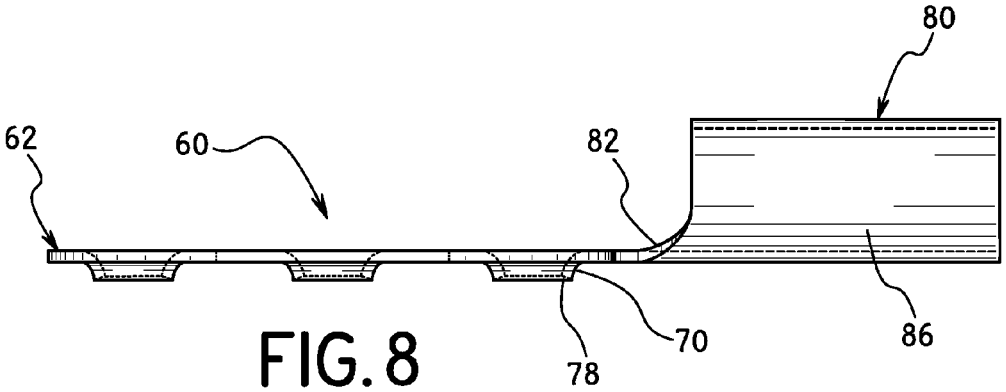
FIG. 8 is a side elevational view of the electrical connector of FIG. 7.
Figure 9:
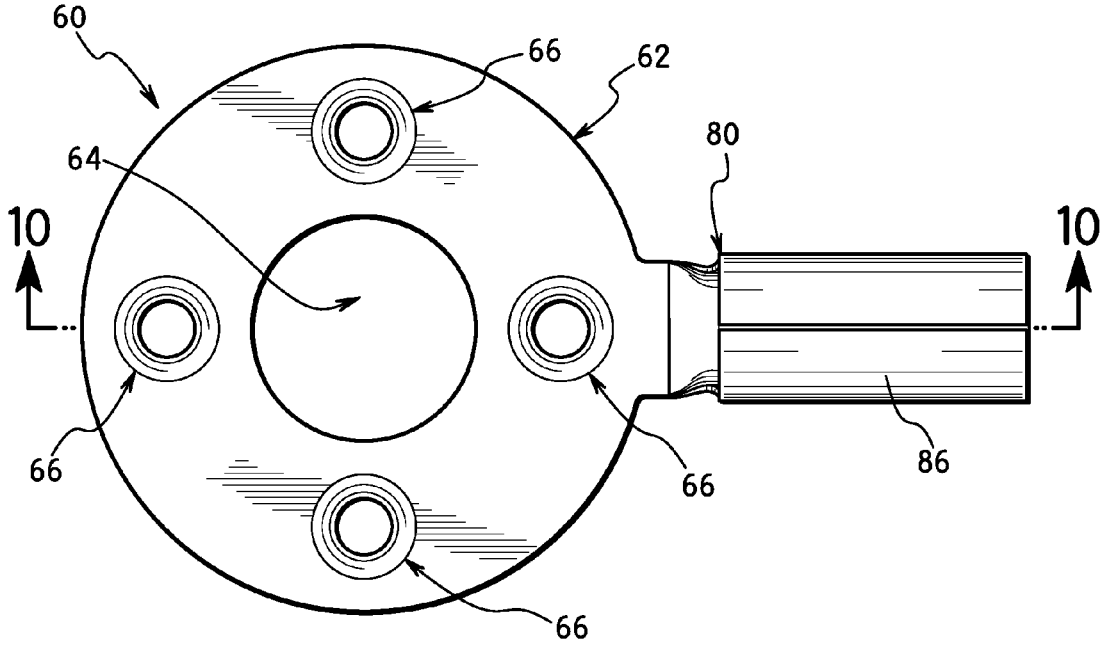
FIG. 9 is a top plan view of the electrical connector of FIG. 7.
Figure 10:
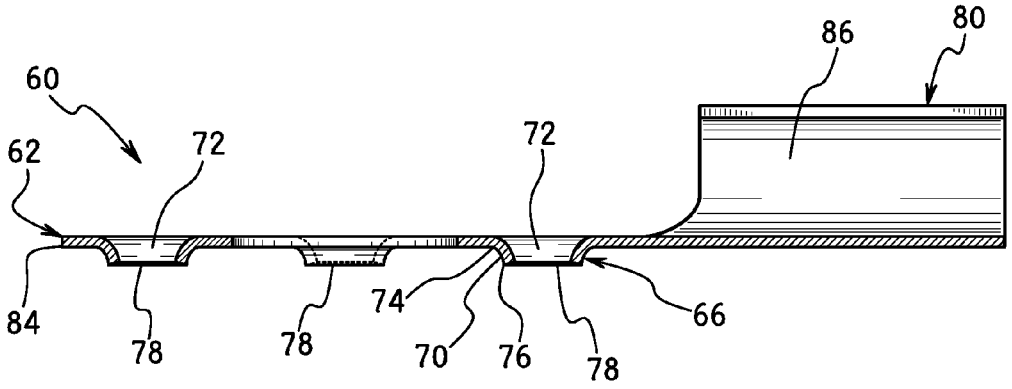
FIG. 10 is a cross-sectional side elevational view of the electrical connector taken along line 10-10 of FIG. 9.

The electrical connector 12 in the embodiment of FIGS. 1-6 has a single projection 30 extending away from the surface of the body 18 and surrounding the central aperture 28 for receiving a fastener. In another embodiment shown in FIG. 7-10, the electrical connector 60 has a substantially planar body 62 with a central aperture 64 in a manner similar to the previous embodiment for receiving a fastener or other coupling and clamping the connector to a base in a manner substantially the same as in the embodiment of FIGS. 1-6. In this embodiment, the body 62 has a plurality of projections 66 extending from the bottom surface 68 of the body 62. As shown in FIG. 7, four projections 66 are provided. The projections 66 in the embodiment shown are uniformly and equally spaced apart around the central aperture 64. The projections 66 are similar to the projection 30 in the embodiment of FIGS. 1-6 and have a substantially frustoconical shape formed by a continuous annular, tapered side wall 70 surrounding an axial passage 72. The side wall 70 has a first base end 74 integrally formed with the body 62 and an outer end 76 forming an annular edge 78 facing outwardly with respect to the plane of the body 62. The frustoconical shaped side wall 72 converges or tapers inwardly toward the center axis of the axial passage 72 to form a truncated, hollow volcano-like shape. The body 62 has a substantially annular shaped with the projections equally spaced apart around the central aperture 64.

The electrical connector 60 of the embodiment of FIG. 7 includes an electrical terminal 80 formed by a tab 82 integrally formed with an outer side edge 84 of the body 62. The terminal 80 has a substantially cylindrical cable connector 86 integrally formed with the tab 82. The cable connector 86 is crimped or compressed around the electrical cable in the manner of the embodiment of FIGS. 1-6 to provide electrical connection between the cable and the electrical connector 60.

The electrical connector 60 is coupled to an electrical assembly in the manner of the embodiment of FIGS. 1-6 by a fastener or other clamping member passing through the central aperture 64 to clamping the electrical connector to an electrical component, such as a metal base, where the annular edges 78 of the respective projection 66 penetrate a coating or oxidized layer of the electrical component to ensure an electrical connection between the electrical connector 66 and the electrical component.

Figure 11:
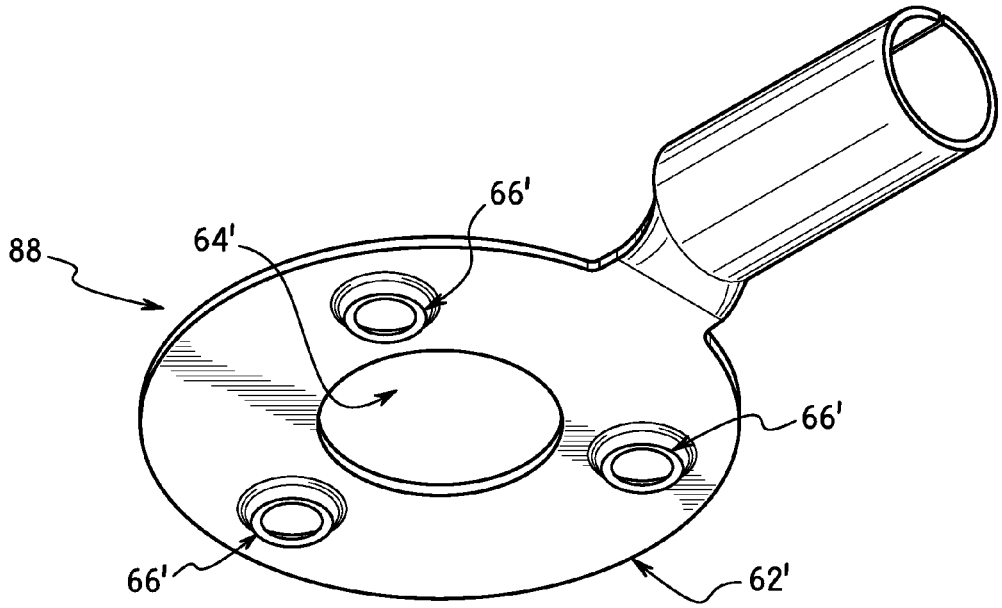
FIG. 11 is a bottom perspective view of the electrical connector in a third embodiment the invention.
Figure 12:
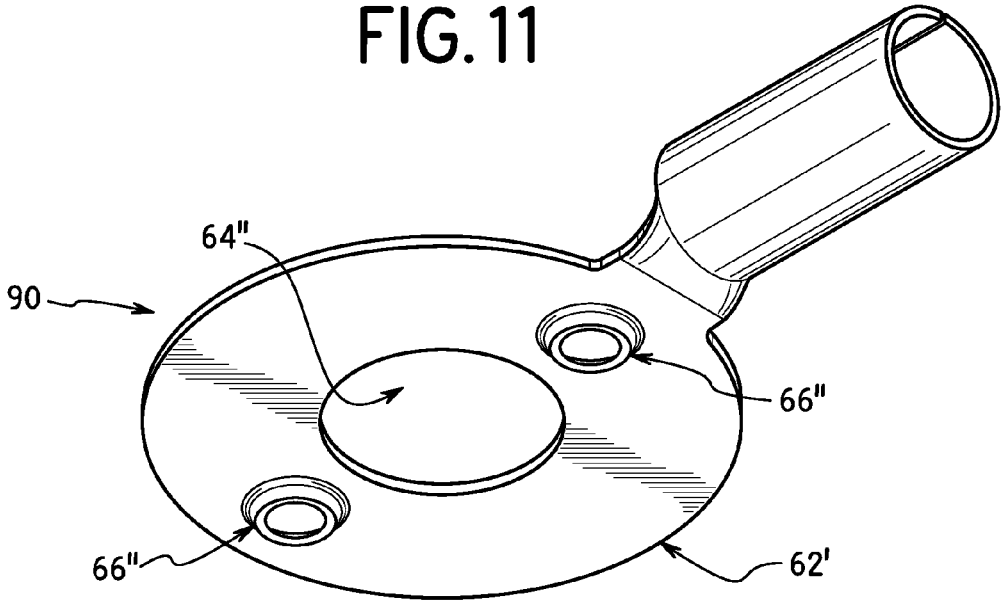
FIG. 12 is a bottom perspective view of the electrical connector in a fourth embodiment of the invention.

In another embodiment shown in FIG. 11, the electrical connector 88 is similar to the electrical connector 60 of FIG. 7 so that the same parts are identified by the same reference number with the addition of a prime. In the embodiment of FIG. 11, three projections 66' are equally spaced around the central aperture 64'. The projections extend outwardly from the plane of the body 62' a distance to penetrate the surface of the electrical component for providing an electrical connection. In the embodiment of FIG. 12, the electrical connector 90 is provided with two projections 66" spaced apart on opposite sides of the central aperture 64". The electrical connector of FIG. 12 is similar to the embodiment of FIGS. 1-7 so that the same or similar elements are identified by the same reference number with the addition of a double prime.

While various embodiments have been chosen to illustrate the invention, it will be understood by those skilled in the art that various changes and modifications can be made without departing from the scope of the invention as defined in the appended claims.

What is claimed is:

1. A one-piece, unitary electrical connector comprising:

a substantially planar body having a substantially planar first surface on a first side and a substantially planar second surface on a second side opposite said first surface, and a central aperture extending between said first surface and said second surface and having a dimension to receive a fastener, said central aperture defining an annular inner edge of said body;

an annular frustoconical shaped projection extending only from said annular inner edge on said first surface of said body and surrounding said central aperture and configured for penetrating a surface of a metal base; and an electrical terminal integrally formed with said body, and extending radially outward from a side edge of said body for coupling directly to an electrical cable and to provide an electrical connection between the electrical cable and said body.

2. The electrical connector of claim 1, wherein said electrical terminal includes a tab integrally formed with said body and extends radially outward from said side edge of said body; and a substantially cylindrical shaped cable connector integrally formed with said tab, said cable connector having an axial passage with a dimension for receiving the electrical cable.

3. The electrical connector of claim 2, wherein said terminal is deformable by crimping to couple the electrical cable to said terminal.

4. The electrical connector of claim 2, wherein said terminal has a longitudinal dimension extending radially outward from said side edge of said body and is oriented on said second side of said body.

5. A one-piece unitary electrical connector comprising:

a body having a substantially planar configuration with a substantially planar first surface and a substantially planar second surface opposite said first surface, and a central aperture extending between said first surface and said second surface;

a plurality of frustoconical shaped projections extending from said first surface and oriented only on a first side of said body and substantially surrounding said central aperture, each of said frustoconical shaped members have a base end integrally formed with said body and an open distal end defining an axial passage spaced from said central aperture, and an annular contact surface around said axial passage;

a terminal having a tab extending radially from said side edge of said body and having a substantially cylindrical shaped cable connector extending radially outward from said body and oriented on a second side of said body opposite said first side; and an electrical cable received in said cylindrical cable connector, said cylindrical cable connector being crimped onto said electrical cable to provide an electrical connection between said electrical cable and said body.

6. The electrical connector of claim 5, wherein each said frustoconical shaped projection comprises a single, continuous frustoconical shaped member substantially surrounding an axial passage and projecting outwardly from a plane of said first surface.

7. The electrical connector of claim 5, wherein said frustoconical shaped projections project outwardly from said first surface of said body and are substantially uniformly spaced around said central aperture.

8. The electrical connector of claim 7, wherein each of said frustoconical shaped members have a base end integrally formed with said body and a distal end defining an annular edge with a dimension for making electrical contact with an electrically conducting base member.

9. The electrical connector of claim 5, wherein said cylindrical shaped cable connector has an axial passage receiving said electrical cable, and where said axial passage extends radially outward from an axis of said central aperture.

10. An electrical assembly comprising:

a metal base having an aperture extending through an outer surface of said metal base;

a metal clamping member overlying said outer surface of said metal base and having an aperture extending through said metal clamping member and aligned with said aperture in said metal base;

an electrical connector positioned between said metal base and said metal clamping member, said electrical connector having a body with a substantially planar first surface and a substantially planar second surface opposite said first surface, an aperture extending between said first surface and second surface and aligned with said aperture in said metal base and said metal clamping member, a continuous frustoconical shaped projection extending only from an inner edge of said first surface and surrounding said aperture, said frustoconical shaped projection having an inner annular edge defining said aperture, and an electrical terminal integrally formed with said body and coupled to a first end of an electrical cable; and a fastener extending through said apertures in said metal base, said metal clamping member and said body, and clamping said body between said metal base and said metal clamping member with said frustoconical shaped projection penetrating a surface of said metal base and providing an electrical connection between said electrical cable and said metal base and metal clamping member.

11. The electrical assembly of claim 10, wherein said aperture in said metal base is a threaded aperture, and said fastener is a threaded fastener extending through said aperture in said clamping member and said electrical connector and threaded into said threaded aperture.

12. The electrical assembly of claim 10, wherein said electrical terminal includes a tab extending radially outward from a side edge of said body, and a cylindrical shaped cable connector integrally formed with said tab, said cable connector having an axial passage receiving said electrical cable, said cable connector being crimped to couple said electrical cable to said terminal.

13. The electrical assembly of claim 10, wherein said electrical terminal includes a tab extending radially outward from a side edge of said body and a cable connector coupled to said electrical cable providing an electrical connection between said electrical cable and said metal base, and where said terminal is oriented on a second side of said body opposite said frustoconical shaped projection.

14. The electrical assembly of claim 13, further comprising a second electrical connector coupled to a second end of said electrical cable, said second electrical connector having a planar body, and aperture extending through said planar body with a dimension for receiving a fastener, and a frustoconical shaped projection extending from an inner edge of said aperture where said projection has an inner annular edge defining said aperture.

* * * * *